US009597787B2

(12) United States Patent
Szewc et al.

(10) Patent No.: US 9,597,787 B2
(45) Date of Patent: Mar. 21, 2017

(54) IINSERTION TOOL

(71) Applicant: Newfrey LLC, Newark, DE (US)

(72) Inventors: Jan Szewc, Roxbury, CT (US); Neil F. Baldino, Sandy Hook, CT (US)

( * ) Notice: Subject to any disclaimer, the term of this patent is extended or adjusted under 35 U.S.C. 154(b) by 58 days.

(21) Appl. No.: 14/246,478

(22) Filed: Apr. 7, 2014

(65) Prior Publication Data

US 2015/0283688 A1 Oct. 8, 2015

(51) Int. Cl.
*B25B 27/14* (2006.01)

(52) U.S. Cl.
CPC ..... *B25B 27/143* (2013.01); *Y10T 29/49881* (2015.01); *Y10T 29/53691* (2015.01)

(58) Field of Classification Search
CPC ..... Y10T 29/49947; Y10T 29/49963; Y10T 29/49881; Y10T 29/53691; Y10T 29/53961; Y10T 29/53943; F16B 7/0406; B25B 27/143
See application file for complete search history.

(56) References Cited

U.S. PATENT DOCUMENTS

| | | | | |
|---|---|---|---|---|
| 2,586,805 | A | 2/1952 | Forster | |
| 3,579,793 | A | 5/1971 | Williams | |
| 4,528,737 | A | 7/1985 | Cosenza | |
| 4,682,412 | A | 7/1987 | Pfeffer | |
| 4,980,959 | A | 1/1991 | Czarnowski | |
| 6,000,114 | A | 12/1999 | Newton | |
| 6,421,899 | B1 | 7/2002 | Zitnay | |
| 6,470,557 | B2 | 10/2002 | Newton | |
| 7,634,844 | B2 | 12/2009 | Szewc | |
| 8,474,118 | B2 | 7/2013 | Hondo | |
| 2010/0147117 | A1* | 6/2010 | Hsieh | B25B 23/0021 81/177.85 |

* cited by examiner

*Primary Examiner* — Jason L Vaughan
*Assistant Examiner* — Amanda Meneghini
(74) *Attorney, Agent, or Firm* — Kofi A. Schulterbrandt; Michael P. Leary

(57) ABSTRACT

An insertion tool is used to insert a threaded coil insert into a threaded opening of a support structure. The tool includes a rotatable mandrel body having an axial longitudinal passage and a projection slot. A plunger is disposed in the passage forward of a spring which urges the plunger forward. The plunger in turn urges a drive projection. A front end of the plunger includes an inclined surface that slidingly and inclinedly engages an inclined surface of the drive projection. The urging of the drive projection by the plunger along their respective inclined surfaces causes relative sliding movement of the drive projection so that the drive projection translates linearly through the projection slot in a direction perpendicular to the longitudinal passage.

8 Claims, 8 Drawing Sheets

IINSERTION TOOL

BACKGROUND OF THE INVENTION

This invention relates to an insertion tool, and particularly relates to a power driven tool for inserting Tang-free helical coil inserts into tapped openings.

Helical coil inserts have been used for some time to revitalize worn or damaged threads of openings in support structures. Such inserts also have been used to provide a durable threaded opening in support structures which are composed of materials which may not be sufficiently durable to support long-term use of threads therein. The threads of the coil inserts will remain durable for a longer period, compared to the threads of the opening of the support structure, even though there may be frequent removal and reinsertion, or replacement, of threaded fasteners eventually mounted in threaded opening of the coil insert.

The helical coil inserts are typically made from a pre-formed metal wire, typically formed with a diamond shaped cross-section, which is wound to form a helical coil having successive convolutions. The helical coil is referred to herein as a "coil insert." The coil insert is wound in such a manner that outer and inner threads are formed by sharp, generally "V" shaped portions on opposite sides of the diamond cross section on the outer and inner surfaces, respectively, of the insert.

The size of the outer threads of the coil insert are consistent with the size of the threads of the opening in the support structure. The size of the inner threads of the coil insert are consistent with the size of the threads typically formed on a portion of the outer surface of the threaded fastener, which is eventually threadedly mounted in coil insert.

In the past, one end of the coil insert was formed with a straight tang to extend diametrically across the immediately adjacent full convolution, and was used to drive the coil insert into the threaded opening of the support structure. In more recent times, the coil insert has not been formed with the tang, but has been formed with a drive notch on the inside of the last convolution near the end of the insert which serves as the facility to drive the insert into the threaded opening of the support structure.

In the past, the coil inserts have been assembled by use of a tool such as, for example, the tool disclosed in U.S. Pat. No. 4,528,737, which issued on Jul. 16, 1985. The tool of the '737 patent includes a rotatable rod having a cutout extending longitudinally through a portion thereof, but which is closed at opposite ends thereof, including a coil insertion end of the tool. The rod is formed with threads on the exterior thereof which begin inboard of the insertion end of the tool and extend toward the opposite end thereof. A longitudinal pawl is mounted pivotally in the cutout and is formed with a pair of lead ramps extending inboard from the insertion end of the pawl. The rod is also formed with a hook portion inboard of the lead ramps and is biased so that the ramps and the hook portion can protrude through a lateral aperture formed through the rod and in communication with the cutout.

In use of the tool of the '737 patent, the coil insert is threadedly assembled on the insertion end of the rod until the biased hook portion is located in the drive notch of the insert. At this juncture, the lead end of the coil insert and the hook portion are located somewhat rearward of the insertion end of the rod and the tool. A power driver is then used to rotate the rod and the pawl, as the insert and rod are inserted into the threaded opening of the support structure, whereby the hook portion drives the insert into the threaded opening.

For at least two reasons the prior art designs (including the '737 design) are less than ideal. First, because the hook of the prior art (e.g., '737) travels in a radially sweeping path toward the coil notch, it changes longitudinal position in the direction of pitch along its path. Because the drive notch of a coil is small, the change in position in the direction of pitch could significantly affect the alignment of the hook with the notch. Second, different amounts of sweep of the hook mean that the hook will have different orientations as it is positioned to engage notches. Therefore, as the hook contacts various coils during installation, such contact will be at different orientations and with different portions of the hook and therefore encourage uneven wear of the hook over time. Such wear may eventually compromises precision engagement between the tool's hook and the drive notch of the coil.

Thus, there is a need for an insertion tool which has a hook portion that extends to engagement with the coil drive notch via a linear motion to minimize the uncertainty of the hook-to-notch path and to maintain perfect alignment of the hook with the drive notch of the coil no matter the size or configuration of the coil. There is also a need to develop a tool that eliminates engagement of the hook with the coil at various orientations of the hook to minimize wear of the hook over time.

SUMMARY OF THE INVENTION

The present disclosure describes an insertion tool for inserting a threaded insert within a threaded opening of a support structure. The tool has a rotatable mandrel having a mandrel insertion end and a driven end located at opposite ends of a longitudinal axis of the mandrel. The mandrel has a first passage formed in the mandrel along a directional axis that is generally perpendicular to the longitudinal axis. The first passage defines a projection slot at an end of the mandrel. In addition, the tool includes a drive projection that is confined to travel within the first passage along the directional axis. The drive projection includes a projection stop for limiting travel of the drive projection along the directional axis and a drive hook for engaging a threaded insert. The tool also includes a bias member that engages with the drive projection such that the bias member urges the drive projection to extend the drive hook proud of the projection slot. Furthermore, the projection stop engages a stop portion on the mandrel to limit travel of the drive projection within the first passage.

It is, therefore, an object of this invention to provide an insertion tool for inserting a threaded insert within a threaded opening of a support structure in an efficient and effective manner.

BRIEF DESCRIPTION OF THE DRAWINGS

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
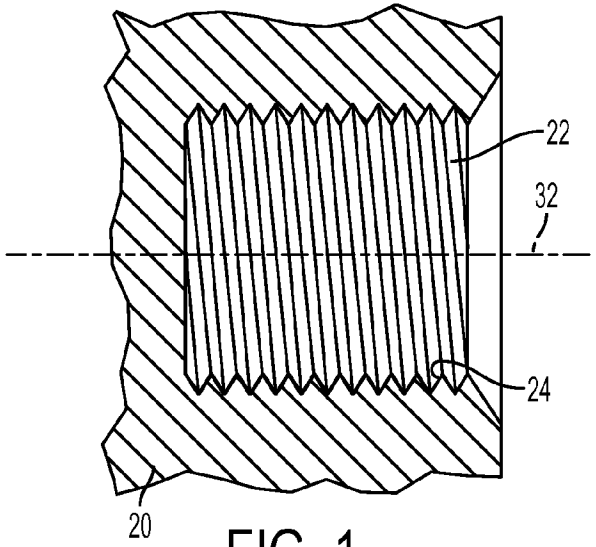
FIG. 1 PRIOR ART
FIG. 1 is a sectional view showing a support structure with a threaded opening formed therein.
Figure 2:
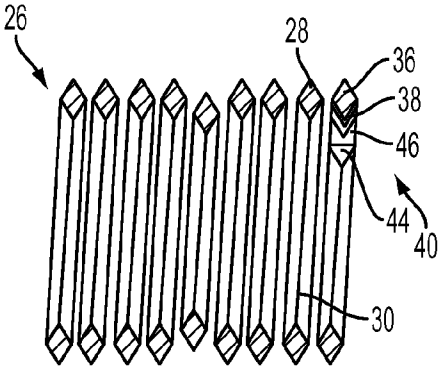
FIG. 2 PRIOR ART
FIG. 2 is a sectional view showing the structure of a helical coil insert for assembly within the threaded opening of FIG. 1.

As shown in FIG. 1, a support structure 20 is formed with a threaded opening 22 having a plurality of threads 24 formed therein. Referring to FIG. 2, a helical coil insert 26 is typically made from a preformed metal wire, typically formed with a diamond cross section, which is wound to form a helical coil having successive convolutions. The coil insert 26 is wound in such a manner that outer threads 28 and inner threads 30 are formed by sharp, generally "V" shaped portions on opposite sides of the diamond cross section on the outer and inner surfaces, respectively, of the insert.

The size of the outer threads 28 of the coil insert 26 are consistent with the size of the threads 24 of the opening 22 in the support structure 20. The size of the inner threads 30 of the coil insert 26 are consistent with the size of the threads typically formed on a portion of the outer surface of a threaded fastener (not shown), which eventually is to be threadedly mounted in coil insert.

The coil insert 26 may be used for facilitating the effective reconstruction of a fastener-receiving threaded opening in the support structure 20. In the reconstruction process, the original opening in the support structure 20, as shown in FIG. 1, is bored to remove worn or damaged threads, whereby an oversize, smooth-walled passage is formed about an axis 32. The passage is then tapped to form the threaded opening 22 having the threads 24 of a prescribed size.

If the material from which the support structure 20 is formed is not of acceptable durable quality, the threaded opening 22, and threads 24, may be formed at the time plans are first made to use the support structure for receiving a threaded fastener.

Regardless of whether the coil insert 26 is used in a reconstruction process, or in the initial formation of a fastener-receiving opening, the opening 22 and the threads 24 are formed in the support structure 20 as shown in FIG. 1 in preparation for receipt of the durable coil insert 26.

Figure 3:
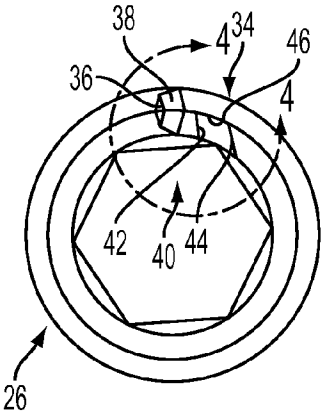
FIG. 3 PRIOR ART
FIG. 3 is an end view of the helical coil insert of FIG. 2 showing a tang-less end of the insert with a drive notch formed therein.
Figure 4:
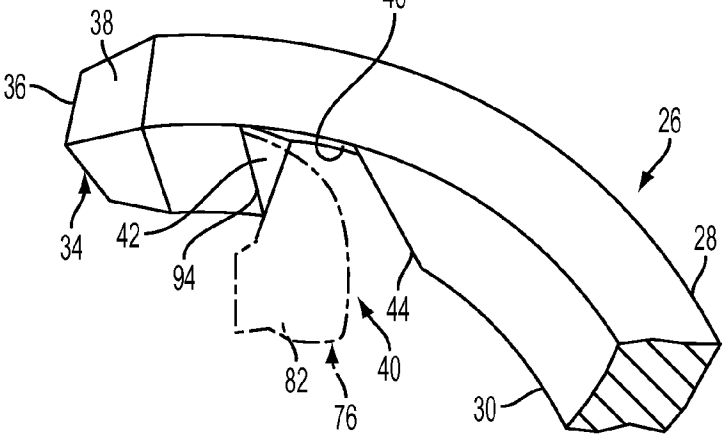
FIG. 4 PRIOR ART
FIG. 4 is a partial view taken within line 4 of FIG. 3 showing an enlargement of a drive end of the tang-free insert of FIG. 3, and showing in phantom a drive hook, in accordance with certain principals of the invention.

Referring to FIGS. 3 and 4, the coil insert 26 is formed with a leading end 34 which includes a leading surface 36 and truncated sides 38. A drive slot 40 is formed in the underside of the leading end 34 just behind the truncated sides 38. The drive slot 40, in the preferred embodiment, is formed by two spaced interfacing walls 42 and 44 and a ceiling 46 by cutting away the radially inside half of the diamond cross section. In addition, the spaced walls 42 and 44 are sloped radially inward and rearward toward a trailing end of the coil insert 26.

Figure 5:
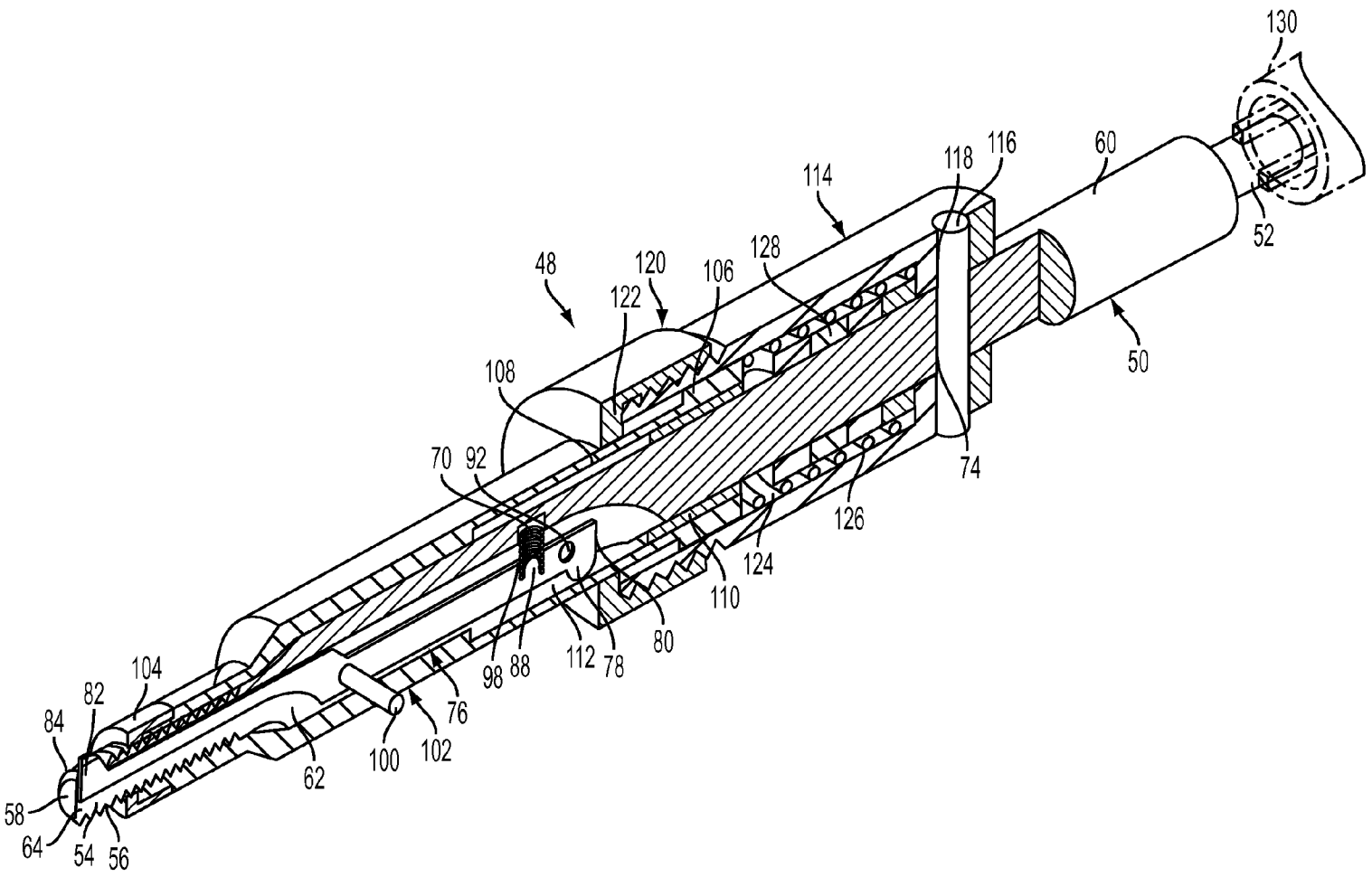
FIG. 5 PRIOR ART
FIG. 5 is a sectional view showing an insertion tool for inserting the insert of FIG. 2 into the opening of FIG. 1 in accordance with certain principles of the invention.

As shown in FIG. 5, an insertion tool 48 is used for inserting the coil insert 26 threadedly into the threaded opening 22 of the support structure 20. The tool 48 includes a rotatable mandrel 50, also shown in FIGS. 6 and 7, which is formed with a drive shank 52 at a trailing end thereof and a forward extension 54 at a mandrel insertion end thereof. The forward extension 54 of the mandrel 50 is formed with threads 56 externally thereof which are the same size as the inner threads 30 of the coil insert 26. The forward extension 54 is also formed with a forward end face 58 which is the forwardmost surface of the mandrel 50. An intermediate section 60 of the mandrel 50 extends between the drive shank 52 and the forward extension 54, and is formed generally with a circular cross section.

Figure 6:
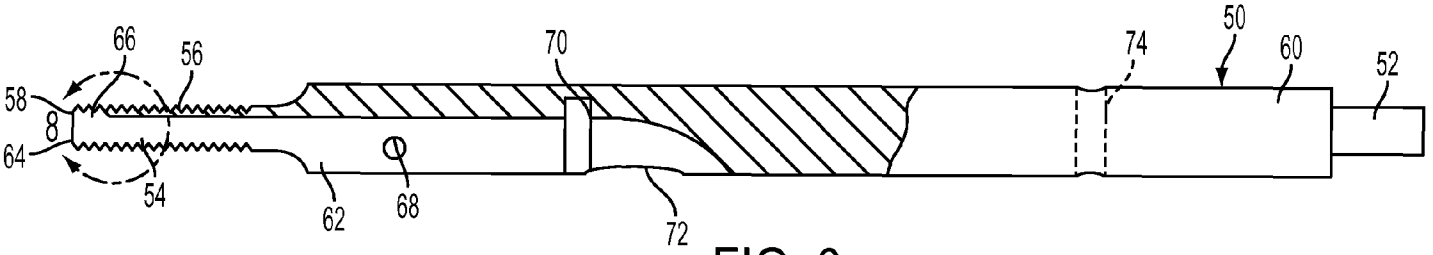
FIG. 6 PRIOR ART
FIG. 6 is a partial sectional view showing of a mandrel of the tool of FIG. 4 in accordance with certain principles of the invention.
Figure 7:
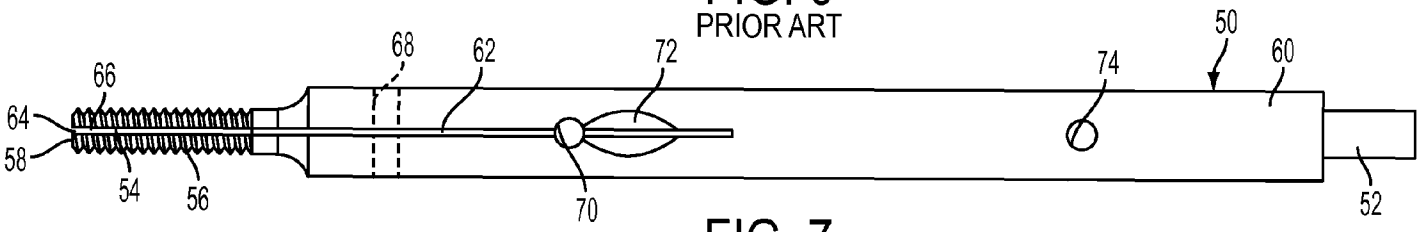
FIG. 7 PRIOR ART
FIG. 7 is a side view showing the mandrel of the tool of FIG. 4 in accordance with certain principles of the invention.
Figure 8:
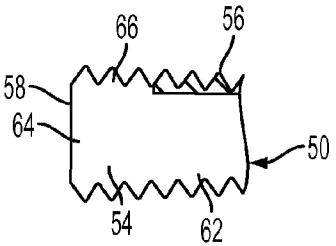
FIG. 8 PRIOR ART
FIG. 8 is a partial side view of an insertion end of the mandrel of FIGS. 6 and 7 showing first and second slots and an insertion end opening of the mandrel in communication in accordance with certain principles of the invention.

Referring to FIGS. 6, 7 and 8, the mandrel 50 is formed with a first slot 62 in a first side thereof which extends transaxially into the mandrel but does not extend to the opposite side thereof. A forward end opening or end slot 64 is formed in the forward end face 58 of the mandrel 50 and communicates with the first slot 62. A second slot 66 is formed in the forward extension 54 transaxially into the mandrel 50 in a second side, which is diametrically opposite the first side, and is in communication with the first slot 62 and the end opening 64. The first slot 62, the end opening 64 and the second slot 66 are formed with the same width.

As shown in FIGS. 6 and 7, the mandrel 50 is formed with a pivot pin opening 68 laterally on each side of the first slot 62 at a juncture near the axial middle of the first slot. A spring cavity 70 is formed in the mandrel 50 generally in the plane of the first slot 62 and rearward of the opening 68. The cavity 70 is open to the first side of the mandrel 50 as the first slot 62, and extends deeper into the mandrel than the first slot but does not extend through the mandrel. A concave section 72 is formed in the exterior surface of the mandrel 50 at the first side thereof and trails the exterior opening of the cavity 70. A body pin hole 74 is formed through the mandrel 50 near the shank 52 thereof.

Figure 9:
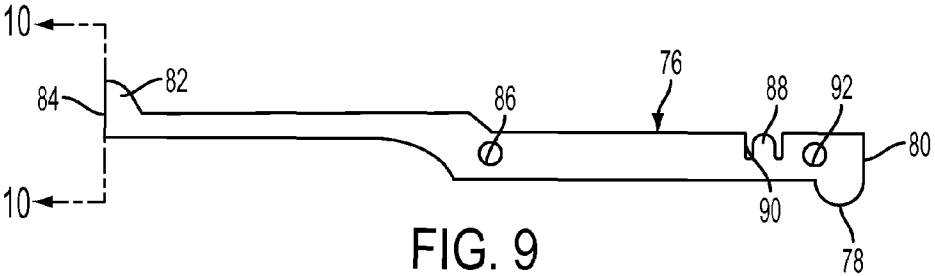
FIG. 9 PRIOR ART
FIG. 9 is a side view showing a blade and the drive hook of FIG. 4 in accordance with certain principles of the invention.
Figure 10:
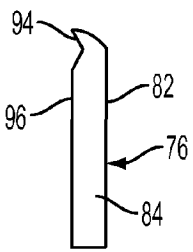
FIG. 10 PRIOR ART
FIG. 10 is an end view of the blade showing the profile of the drive hook formed on the insertion of the blade in accordance with certain principles of the invention.

As shown in FIGS. 5 and 9, a blade 76 is formed in a longitudinal direction and with a thickness slightly less than the width of the first slot 62 of the mandrel 50. A rounded nib 78 extends laterally in one direction from a trailing end 80 of the blade 76, and a drive extension 82 extends laterally in an opposite direction from a forward or insertion end face 84 of the blade. A pivot pin opening 86 is formed through a central portion of the blade 76. A spring-support finger 88 is formed in the blade 76 and extends from within a well 90 in a direction opposite the direction of the nib 78, slightly inboard of the trailing end 80. Another hole 92 is formed through the blade 76 and is located between the nib 78 and the finger 88. Referring to FIG. 10, the drive extension 82 of the blade 76 is formed with a drive hook 94 on a lateral side 96 of the blade.

Referring to FIG. 5, a spring 98 is placed onto the finger 88 and the blade 76 is moved into the first slot 62 of the mandrel 50 so that the spring moves into the cavity 70 and is compressed to apply a normal clockwise bias, as viewed in FIG. 5, to the blade. A pivot pin 100 is inserted into the opening 68 of the mandrel 50 and the opening 86 of the blade 76 to couple the blade to the mandrel for pivoting movement within the first slot 62. When the blade 76 is in the position shown in FIG. 5, the drive extension 82 is extended through the second slot 66 (FIG. 8) under the biasing action of the spring 98.

As shown in FIG. 5, the forward or insertion end of the blade 76 is located within the forward end opening 64 of the mandrel 50 and is positioned so that the forward end face 84 of the blade is, at all times, flush with the forward end face 58 of the mandrel. In this manner, the forward end of the blade 76 is always at the forwardmost location of the tool 48. In addition, the drive hook 94 of the blade 76 extends inward from the forward end face 58 through the thickness of the drive extension 82. Therefore, the drive hook 94 is always at the forwardmost location of the tool 48.

The forward half of the mandrel 50 is located within a sleeve 102 having a plastic spinner 104 attached to a forward end thereof and formed with a flange 106 at a rear end thereof. The sleeve 102 is formed internally in the rear half thereof with an enlargement 108 and a bushing 110 is press fit, or otherwise secured, within the rear end of the enlargement. This arrangement forms a first chamber 112 into which the nib 78 of the blade 76 may be biasingly located as illustrated. It is noted that the sleeve 102 and the bushing 110 could be formed as a single piece without departing from the spirit and scope of the invention.

A cylindrical body 114 is located about the intermediate section 60 of the mandrel 50 and is secured to the mandrel by a pin 116 which is passed through a split opening 118, formed in the body, and the opening 74 in the mandrel. The flange 106 of the sleeve 102 is located for sliding movement relative to the interior of the body 114. A cup-like nut 120 is located about the middle of the intermediate section 60 of the mandrel 50 and is threadedly attached to a forward end of the body 114. A forward wall 122 of the nut 120 and the interior of the body 114 combine to form a second chamber 124 in which the flange 106 of the sleeve 102 is captured. A spring 126 is located within the second chamber 124 and normally urges the sleeve 102 and the bushing 110 in a forward direction. A selected number of washer-like spacers 128 are located within the second chamber 124, and are positioned about the intermediate section 60 of the mandrel 50, to limit the rearward movement of the sleeve 102 and the bushing 110.

In an "at rest" or normal condition when the tool 48 is not being used, the spring 126 biases the flange 106 and the bushing 110 to the forwardmost position whereby the flange engages the inboard side of the forward wall 122 of the nut 120. In this position, the forward end of the sleeve 102 and the spinner 104 essentially cover the threads 56 of the mandrel 50. Also, the bushing 110 is now located in a forward section of the first chamber 112 and has engaged the nib 78 of the blade 76 to move the nib upward, as viewed in FIG. 5, against the biasing action of the spring 98. During the period when the bushing 110 is in engagement with the nib 78, as described above, the blade 76 is pivoted about the pin 100 to retract the drive extension 82 to a position within the first slot 62 of the mandrel 50. In this manner, the drive extension 82 and the drive hook 94 are not unnecessarily exposed during any period when the tool 48 is in the normal condition.

When the tool 48 is to be used, the trailing non-slotted end of the coil insert 26 is threaded onto the forward end of the threads 56 of the mandrel 50 by virtue of the threads 56 and the inner threads 30 of the insert being of the same size. As the insert 26 is threaded onto the forward end of the mandrel 50, the trailing end of the insert engages the forward face of the spinner and urges the sleeve 102 rearward against the biasing action of the spring 126. As the sleeve 102 is being moved rearwardly, the bushing 110 is moved rearward relative to the nib 78 of the blade 76. During this period, the drive extension 82 remains retracted within the first slot 62 because the bushing 110 continues to engage and urge the nib 78 radially inward of the slot 62.

Eventually, as the coil insert is being mounted onto the threaded end of the mandrel 50, the bushing 110 is moved rearward sufficiently to clear the nib 78 whereafter the biasing action of the spring 98 urges the nib in a radially outward direction to pivot the drive extension toward the second slot 66. The drive slot 40 of the coil insert 26 is moved into position to receive the drive hook 94 of the blade 76 in the manner illustrated in FIG. 4. The shank 52 of the "loaded" tool 48 is attached to a power driver 130 to prepare the tool for threadedly inserting the coil insert 26 into the threaded opening 22 of the support structure 20. The power driver 130 could be, for example, an electronic torquesensing driver available from Hios as their Model SB 650C.

The forward end of the tool 48 is positioned at the mouth of the threaded opening 22 of the support structure 20 and the leading end of the coil insert 26 is positioned to threadedly engage the threads 24 of the opening. Thereafter, the power driver 130 is operated and the drive hook 94 is rotated against the wall 42 of the slot 40, formed in the coil insert 26, to literally drive the convolutions of the insert into the helical path formed by the threads 24 of the opening 22. Eventually, the forward face of the spinner 104 engages the support structure 20 which causes the sleeve 102 to move further rearward until the flange 106 engages the lead spacer 128. At this time, the power driver 130 senses the increase torque requirement and reverses the direction of rotation of the mandrel 50 to withdraw the threads 56 from engagement with the threads 30 of the coil insert 26.

The number of spacers 128 to be used, or a single spacer of a given axial length to be used, is directly linked to the axial length of the coil insert 26. For short coil inserts 26, relatively more spacers would be required when compared to the number of spacers required for longer coil inserts.

FIGS. 11-18B illustrate the structure of an alternative embodiment to the embodiment of FIG. 5. In this alternate embodiment many elements function in a similar manner as in the embodiment of FIG. 5. However, the invention of FIGS. 11-18B embody some structural differences that will be pointed out below. Applicant appreciates that the alternate embodiment of FIGS. 11-18B may be substituted for various aspects of the embodiment of FIG. 5.

Figure 11:
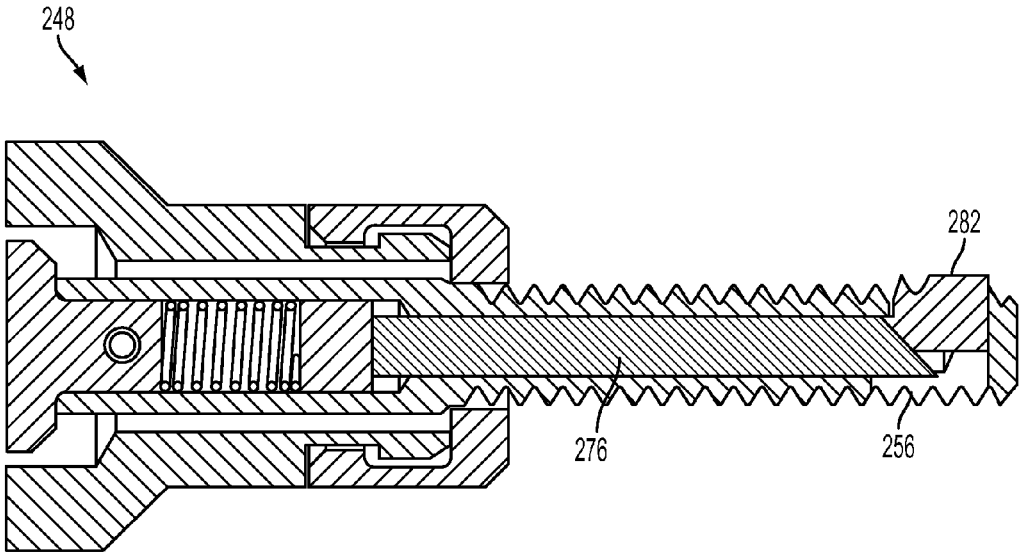
FIG. 11 is a cross-sectional view of an alternative embodiment of the insertion tool of FIG. 5 for inserting the insert of FIG. 2 into the opening of FIG. 1 in accordance with certain principles of the invention.
Figure 12A:
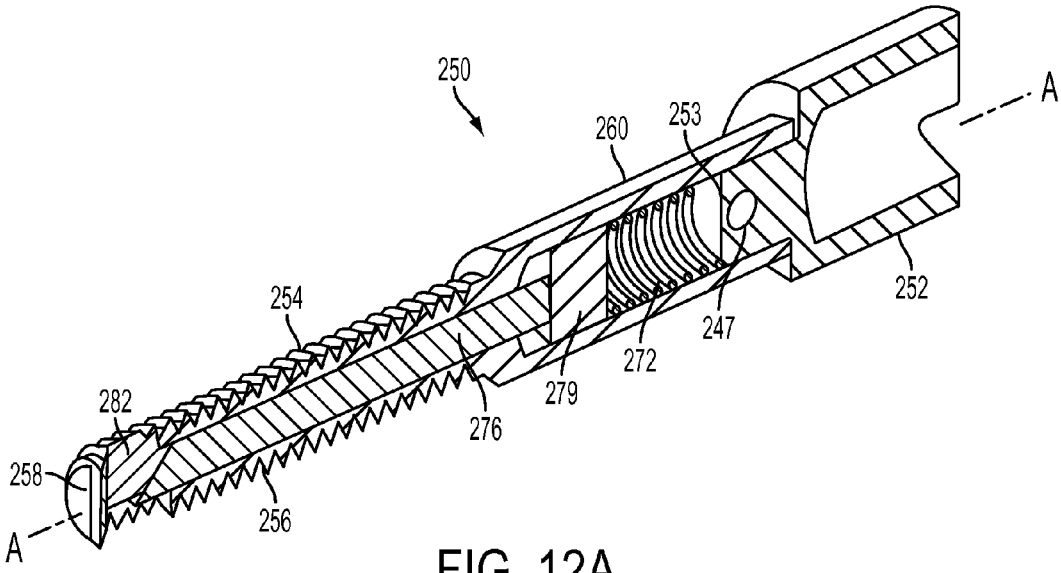
FIG. 12A is a front perspective cross-sectional view of the embodiment of FIG. 11.
Figure 12B:
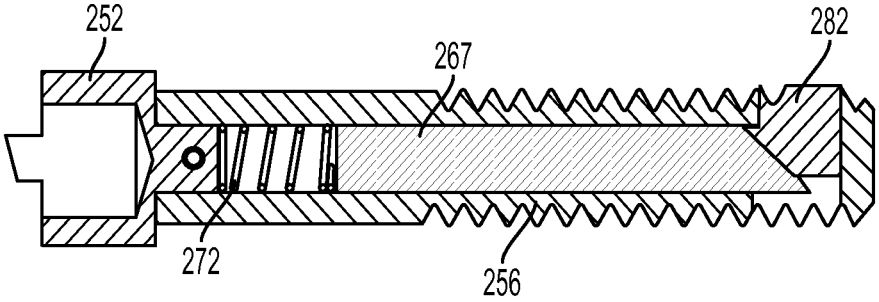
FIG. 12B is a cross-sectional view of the embodiment of FIG. 12A with no spacer.

FIGS. 11, 12A, and 12B illustrate the insertion tool 248 of the present invention. The tool 248 includes a rotatable mandrel 250, a biasing member or spring 272, a plunger 276 and a drive projection 282. Rotatable mandrel 250 has a longitudinal axis A-A. The foregoing members work together to selectively extend drive projection 282 from rotatable mandrel 250 in a manner similar to how drive extension 82 is extended from rotatable mandrel 50 in the embodiment of FIG. 5. FIG. 12B illustrates a configuration of the tool in which plunger 276 is of sufficient diameter such that spacer 279 is not needed. In other words, when the desired spring has a diameter larger than the rear cross-sectional surface of plunger 276, spacer 279 may be included to provide an engagement surface of sufficient diameter. Therefore, spacer 279 is of a generally larger diameter than plunger 276.

FIGS. 13-16 illustrate a mandrel 250. Like mandrel 50, mandrel 250 a forward extension 254 projects toward the front and the mandrel can be driven from the rear by a drill or some similar hand or power tool. The forward extension 254 of the mandrel 250 is formed with threads 256 externally thereof which are the same size as the inner threads 30 of the coil insert 26. The forward extension 254 is also formed with a forward end face 258 which is the forwardmost surface of the mandrel 250. An intermediate section 260 of the mandrel 250 extends between a drive portion 252 and the forward extension 254, and is formed generally with a circular cross section. Intermediate section 260 can have an increased diameter portion relative to forward extension 256.

Mandrel 250 further includes a forward passage 262 and a rearward passage 261 within which plunger 276 is disposed when assembly. As intermediate section 260 has an increased diameter relative to forward extension 254, rearward passage 261 also defines a larger diameter passageway than forward passage 262. At a forward end of forward extension 254 is a projection slot 266 through which drive projection 282 extends. On mandrel 250, opposite from projection slot 266 is assembly slot 263.

Figure 16:
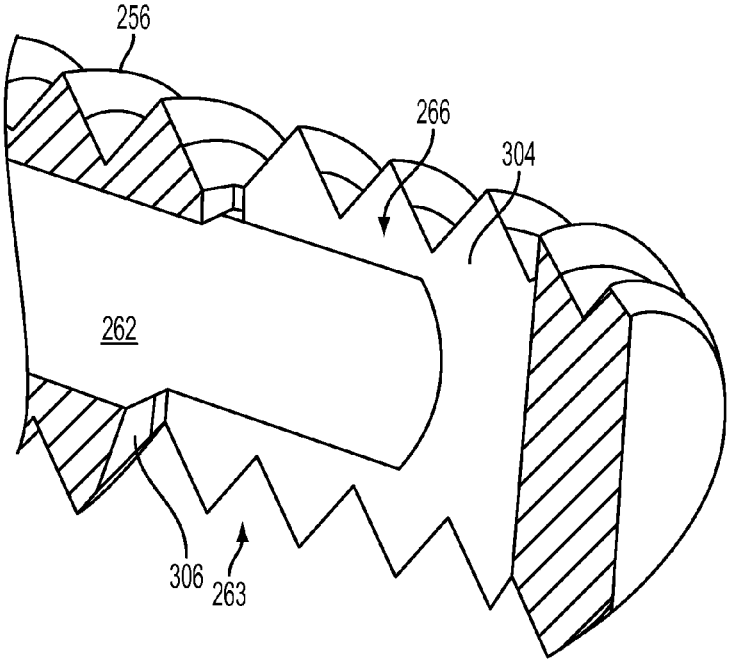
FIG. 16 is an enlarged cross-sectional perspective view of the front end of the mandrel of the embodiment of FIG. 11.

Referring to FIG. 16, mandrel 250 includes a side wall 304. An opposite mirror image side wall (not shown) of side wall 304 along with side wall 304 sandwiches drive projection 282 to direct its travel path within projection slots 266 and 263. In addition, mandrel 250 includes a front wall 302 and an opposite rear wall 306 against which and within which drive projection 282 slidably travels within projection slots 266 and 263. Walls 302, 304, and 306 define restrict drive projection 282 to a travel path that is generally perpendicular to the longitudinal axis A-A of mandrel 250. Furthermore, a stop portion 308 of forward passage 262 serves as a stop that limits or prevents outward or radial projecting of drive projection 282 through projection slot 266. The walls defining the passage within which drive projection 282 travels may be of any form (e.g., flat, cylindrical, etc.) so long as they complement the outer shape of drive projection 282 and slidably define its path.

Figure 17:
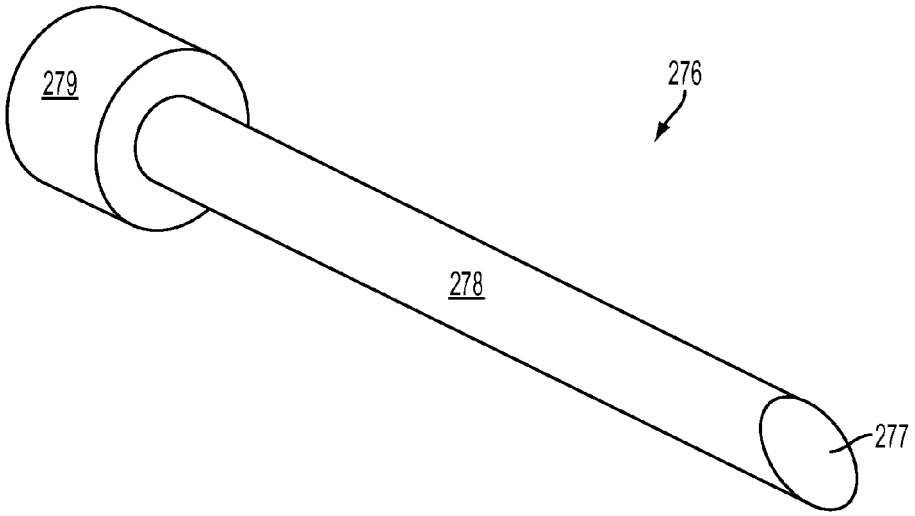
FIG. 17 is a front perspective view of the plunger of the embodiment of FIG. 11.

FIG. 17 shows a front perspective view of plunger 276. Plunger 276 includes a cylindrical forward portion 278 of a predetermined diameter and a cylindrical rearward portion or spacer 279 of a diameter larger than the diameter of cylindrical forward portion 278. Spacer 279 may be secured to or separated from cylindrical forward portion 278 and various longitudinal lengths of spacer 279 may be substituted to adjust the forces and operation among the moving parts of the tool. As shown in FIG. 12B, when assembled, plunger 276 is disposed in rotatable mandrel 250 such that cylindrical rearward portion is received in rearward passage 261 and cylindrical forward portion 278 is received in forward passage 262. Plunger 276 is therefore coaxial with forward and rearward passages 261, 262 upon assembly. Forward and rearward passages 261 and 262 receive plunger 276 in a slidable manner such that plunger 276 may translate along longitudinal axis A-A of rotatable mandrel 250. Forward portion 278 includes an inclined surface 277 on a forwardmost portion thereof for slidingly contacting other elements. Plunger portions 278 and 279 need not be cylindrical and can be any suitable cross-sectional shape (e.g., polygonal).

A bias member or spring member 272 is disposed in rearward passage 261 rearward of rearward portion 279. Drive portion 252 is connected to a rear portion of intermediate section 260 (e.g., via a threaded fastener or pin 247). Drive portion 252 also includes a shoulder or stop 253. Spring member 272 is preloaded or pre-compressed against stop 253 as its rear boundary and against rearward portion 279 as its forward boundary.

During assembly, drive projection 282 is inserted into assembly slot 263. Forward portion 278 and spacer 279 are then inserted into rearward passage 261 until inclined surface 277 engages inclined surface 286. Bias member 272 is then inserted into rearward passage 261 before drive portion 252 is pinned to intermediate section 260. In an alternative embodiment, the biasing member may be compressibly aligned with the direction of travel of the drive projection 282. In this alternate embodiment, the bias member may be positioned below drive projection 282 where assembly slot 263 is located.

Figure 18A:
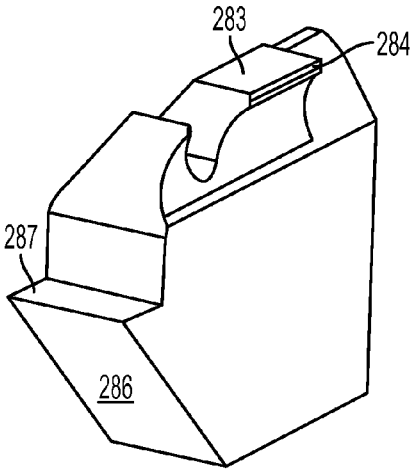
FIG. 18A is a right front perspective view of the drive extension of the embodiment of FIG. 11.
Figure 18B:
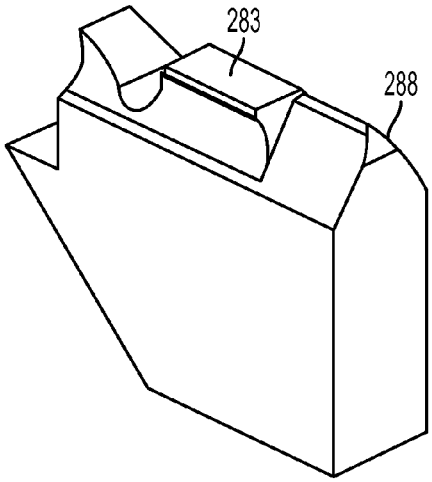
FIG. 18B is a left front perspective view of the drive extension of the embodiment of FIG. 11.

FIGS. 18A-18B show various perspective views of drive projection 282. Specifically, FIGS. 18A and 18B show an inclined surface 286 and a projection shoulder or projection stop 287. A drive hook 283 which operates in a similar manner to drive hook 94 of the FIG. 5 embodiment, extends from a top of drive projection 282. An engagement edge 284 of drive hook 283 extends along a line that is parallel to longitudinal axis A-A and remains parallel thereto during operation.

Figure 13:
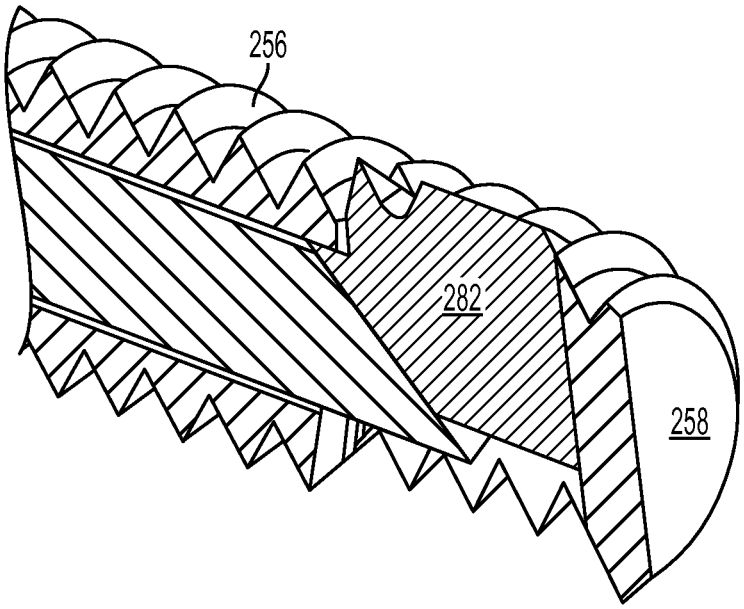
FIG. 13 is a front perspective cross-sectional view of the front end of the embodiment of FIG. 11.
Figure 14:
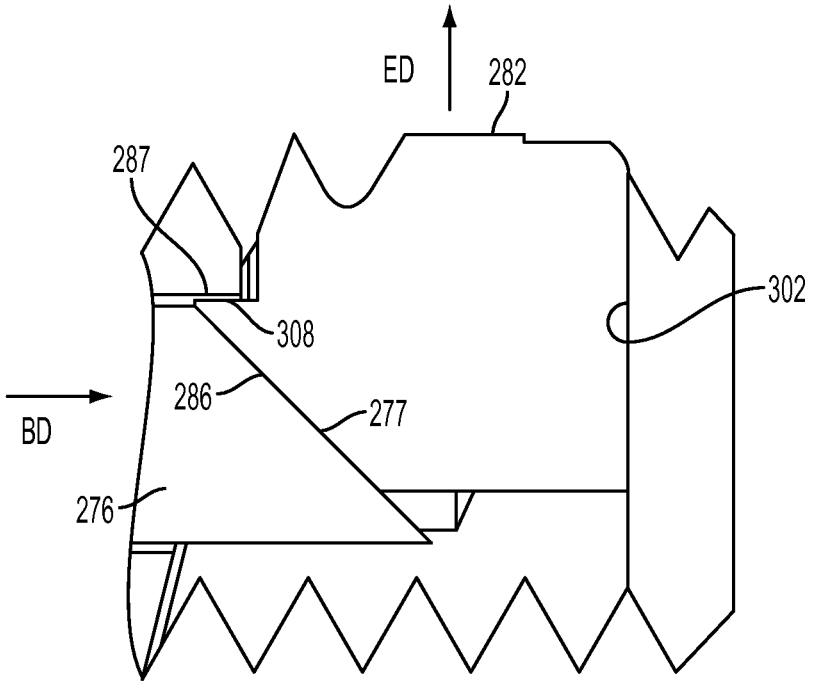
FIG. 14 is an enlarged cross-sectional side view of the front end of the embodiment of FIG. 11.
Figure 15:
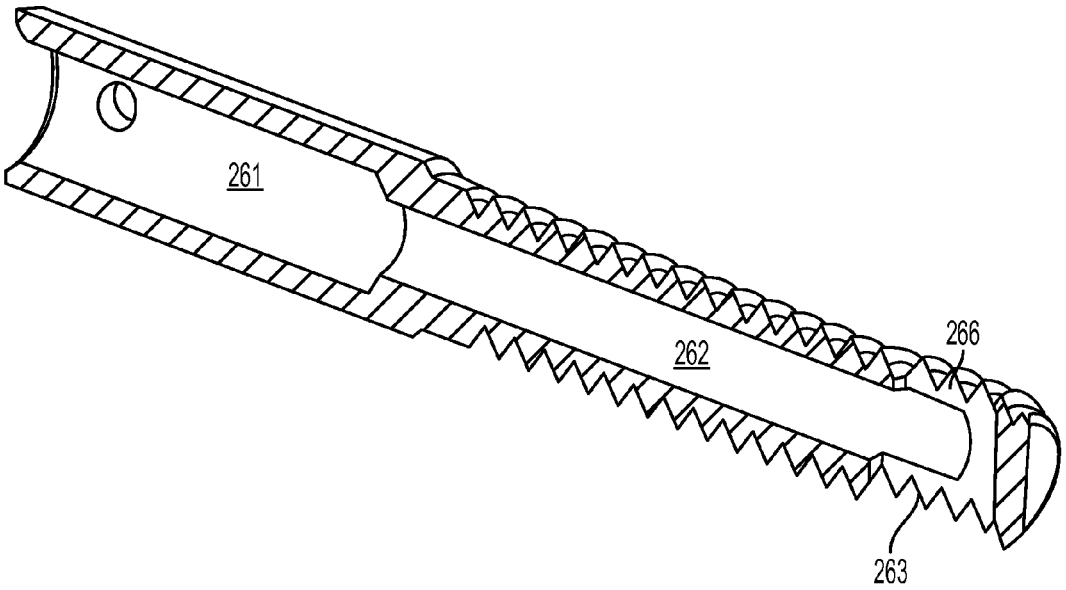
FIG. 15 is a front perspective cross-sectional view of the mandrel of the embodiment of FIG. 11.

FIGS. 13 and 14 show drive projection 282 in an assembled state. To assemble insertion tool 247, plunger 276 is inserted into forward portion 262 followed by spring member 272. Drive portion 252 is then assembled onto the rear end of intermediate section 260 and pinned thereto by pin 247. When assembled, spring member 272 is pre-compressed so that moving plunger 276 rearward requires a force sufficient to overcome the biasing force of spring member 272.

As shown in FIGS. 12 and 14 drive projection 282 is installed by inserting drive projection 282 (top first) through assembly slot 263. Plunger 276 is then inserted into forward passage 262 to its normal frontward biased position shown in FIGS. 13 and 14. Spacer 279 (if necessary) is then inserted into rearward passage 161 followed by bias member 272. A front portion of drive portion 252 is then inserted into rearward passage 161 and pinned to intermediate section 260 via pin 247. As plunger 276 is biased forward in a biased direction BD by bias member 272, its inclined surface 277 slidingly engages inclined surface 286 of drive projection 282 to force drive projection 282 in an upward or engagement direction ED. Drive projection 282 stops moving in direction ED and comes to rest when projection stop 287 engages an inner wall 308 of forward portion 262. In this rest position, engagement edge 284 extends through projection slot 266 and beyond a periphery of threads 256 and remains parallel to longitudinal axis A-A.

In operation, the tool works similarly as described above with respect to the embodiment of FIG. 5. FIG. 18B shows how a front edge 288 of drive projection 282 is slanted to encourage compliance as insertion tool 247 is inserted into a coil insert 26 to be installed. Because drive hook 283 and guide edge 284 maintains a parallel relationship with longitudinal axis A-A, drive hook 283 also remains parallel with respect to interior thread surfaces 30 as drive hook 283 engages interior surfaces 30 during insertion and extraction of mandrel 250. Wear engagement between drive hook 283 and interior surfaces 30 are general parallel and therefore generally even. Such parallel frictional engagement causes generally uniform wear which minimizes the type of uneven wear that compromises effective engagement between drive hook 283 and the coil drive slot 40.

In general, the above-identified embodiments are not to be construed as limiting the breadth of the present invention. Modifications, and other alternative constructions, will be apparent which are within the spirit and scope of the invention as defined in the appended claims.

The invention claimed is:

1. A method of using an insertion tool to install a threaded insert into a support structure comprising the steps of:

providing a rotatable mandrel having a mandrel insertion end and a driven end located at opposite ends of a longitudinal axis of the mandrel;

providing a first passage formed in the mandrel along a directional axis that is generally perpendicular to the longitudinal axis, the first passage defining a projection slot at a first end thereof and an assembly slot at a second opposite end thereof;

providing a drive projection confined to travel within the first passage along the directional axis, the drive projection including a drive hook for engaging the threaded insert;

providing a biasing member engaged with the drive projection such that the biasing member urges the drive projection along the longitudinal axis to extend the drive hook proud of the projection slot; inserting the insertion end of the mandrel into the threaded insert;

engaging an edge of the hook with a drive notch of the threaded insert; and rotating the mandrel to drive the threaded insert into the support structure.

2. A method of using the tool of claim 1, wherein the edge of the hook is parallel to the longitudinal axis.

3. A method of using the tool of claim 1, further comprising the step of allowing the biasing member to compress so the drive projection engages and complies with an interior surface of the threaded insert.

4. A method of using the tool of claim 1, further comprising the steps of:

providing a second passage that extends in a longitudinal direction of the mandrel; and providing a plunger disposed in the second passage;

wherein the biasing member urges the plunger into contact with the drive projection to force the drive projection along the directional axis.

5. A method of using the tool of claim 4, further comprising the steps of:

providing the plunger with a first inclined face and providing the drive projection with a second inclined face, and wherein the first inclined face slidably engages and forces the second inclined face to force the drive projection along the directional axis.

6. A method of using the tool of claim 5, further comprising the steps of:

providing the drive projection with a sloping edge, and wherein during insertion of the insertion end of the mandrel into the threaded insert, the sloping edge contacts the threaded insert and facilitates compliance of the insertion as the biasing member compresses.

7. A method of using an insertion tool to install a threaded insert into a support structure comprising the steps of:

providing a rotatable mandrel having a mandrel insertion end and a driven end located at opposite ends of a longitudinal axis of the mandrel;

providing a first passage formed in the mandrel along a directional axis that is generally perpendicular to the longitudinal axis, the first passage defining a projection slot at an end thereof;

providing a drive projection confined to travel within the first passage along the directional axis, the drive projection also including a drive hook for engaging the threaded insert;

providing a biasing member engaged with the drive projection such that the biasing member urges the drive projection along the longitudinal axis to extend the drive hook proud of the projection slot, the biasing member including an increased diameter spacer at an end thereof, a spring member biasing the biasing member toward the drive projection; inserting the insertion end of the mandrel into the threaded insert;

engaging an edge of the hook with a drive notch of the threaded insert; and rotating the mandrel to drive the threaded insert into the support structure.

8. A method of using an insertion tool to install a threaded insert into a support structure comprising the steps of:

providing a rotatable mandrel having a mandrel insertion end and a driven end located at opposite ends of a longitudinal axis of the mandrel;

providing a first passage formed in the mandrel along a directional axis that is generally perpendicular to the longitudinal axis, the first passage defining a projection slot at an end thereof;

providing a drive projection confined to travel within the first passage along the directional axis, the drive projection also including a projection stop for limiting travel within the first passage and a drive hook for engaging the threaded insert;

providing a biasing member engaged with the drive projection such that the biasing member urges the drive projection along the longitudinal axis to extend the drive hook in the directional axis proud of the projection slot, the travel of the drive projection being limited by contact of the projection stop with the mandrel insertion end;

inserting the insertion end of the mandrel into the threaded insert;

engaging an edge of the hook with a drive notch of the threaded insert; and rotating the mandrel to drive the threaded insert into the support structure.

* * * * *